US005924601A

United States Patent [19]

Chen

[11] Patent Number: 5,924,601

[45] Date of Patent: Jul. 20, 1999

[54] WRIST SPRAYER

[76] Inventor: Chun-Liang Chen, 4 Fl., No. 14, Sub-Lane 10, Lane 583, Jong-Iang North Road, Taipei, Taiwan

[21] Appl. No.: 09/003,576

[22] Filed: Jan. 6, 1998

[51] Int. Cl.[6] ..... B67D 5/64; B67D 13/00

[52] U.S. Cl. ..... 222/175; 222/78

[58] Field of Search ..... 222/78, 175

[56] References Cited

U.S. PATENT DOCUMENTS 4,058,237 11/1977 Luke ..... 222/175
5,088,624 2/1992 Hackett et al. ..... 222/175
5,358,144 10/1994 Mock ..... 222/175
5,669,529 9/1997 Levit ..... 222/78
5,678,730 10/1997 Fabek et al. ..... 222/78

*Primary Examiner*—Andres Kashnikow
*Assistant Examiner*—Keats Quinalty
*Attorney, Agent, or Firm*—Bucknam and Archer

[57] ABSTRACT

A wrist type instantaneous sprayer comprises a pressurized storage tank, a button to release a gas and an adjustable wrist strap. For various purposes, the pressurized storage tank is filled with a compressed gas for the button to controllably release on an appropriate timing, thus facilitating for short distance defense, or for rescuing in case of first aid, or for escaping from a fire in time.

12 Claims, 9 Drawing Sheets

WRIST SPRAYER

FIELD OF THE INVENTION

This invention relates to a sprayer used in self-defense or self-rescue, particularly to a novel structure of a compact sprayer of wrist type for heightening the mobility of self-defense or the immediateness of self-rescue.

A BRIEF DESCRIPTION OF THE PRIOR ART

Generally, the portable self-defense sprayer is in a form of a can. Since such self-defense means is carried in wallet or pocket, its mobility is undesirable and much limited in actual use. Practically, as one who is abruptly attacked has a slim chance to take it out of the wallet or pocket, the effect is not as expected.

On the other hand, a first aid sprayer such as trachea expander for a respiratory patient is generally contained in a vial which the patient carries in the pocket or wallet for ready use. In this case, if a patient gets sick abruptly and no one is within reach to give help, the patient in panic cannot take out immediately the sprayer for use, thus missing the chance of first aid or even passing away.

Furthermore, since a fire is often accompanied with a thick smoke, those present in the fire occurring place are likely to breath in poisonous gases or suffocate for being short of oxygen. And this problem is still unsolved.

SUMMARY OF THE INVENTION

To solve the above problems, the primary object of this invention is to provide a compact sprayer portable around wrist which comprises a pressurized storage tank, button releasing means and an adjustable wrist strap, wherein the button releasing means is provided with a nozzle on the upper portion thereof. In case of need, one will bend his elbow to push the button for a compressed gas to spray out of the nozzle, thus achieving an immediate response to the urgency.

Another object of this invention is to provide a pressurized storage tank which is filled with tear gas and worn on the wrist to serve as a mobile short distance self-defense device, whereby upon being abruptly attacked, one who bends his elbow to push the button may spray the tear gas on the attacker to subsequently escape.

Still another object of this invention is to provide a pressurized storage tank which is filled with the first aid drug and worn on the wrist to serve as an immediate first aid device, whereby a patient who gets sick abruptly may bend his elbow to push the button and hence spray the first aid drug to his nose or mouth.

Further still another object of this invention is to provide a pressurized storage tank which is filled with a liquefied oxygen and worn on the wrist to serve as an effective fire escaping device, whereby in case of fire, one may feed the oxygen into a sealed bag accessible to the mouth or nose or enlarging the escaping chance.

BRIEF DESCRIPTION OF DRAWINGS

The above and other objects features and effects will be more apparent from a description making reference to the accompanied drawings wherein.

A DESCRIPTION OF THE PREFERRED EMBODIMENTS

Figure 1:
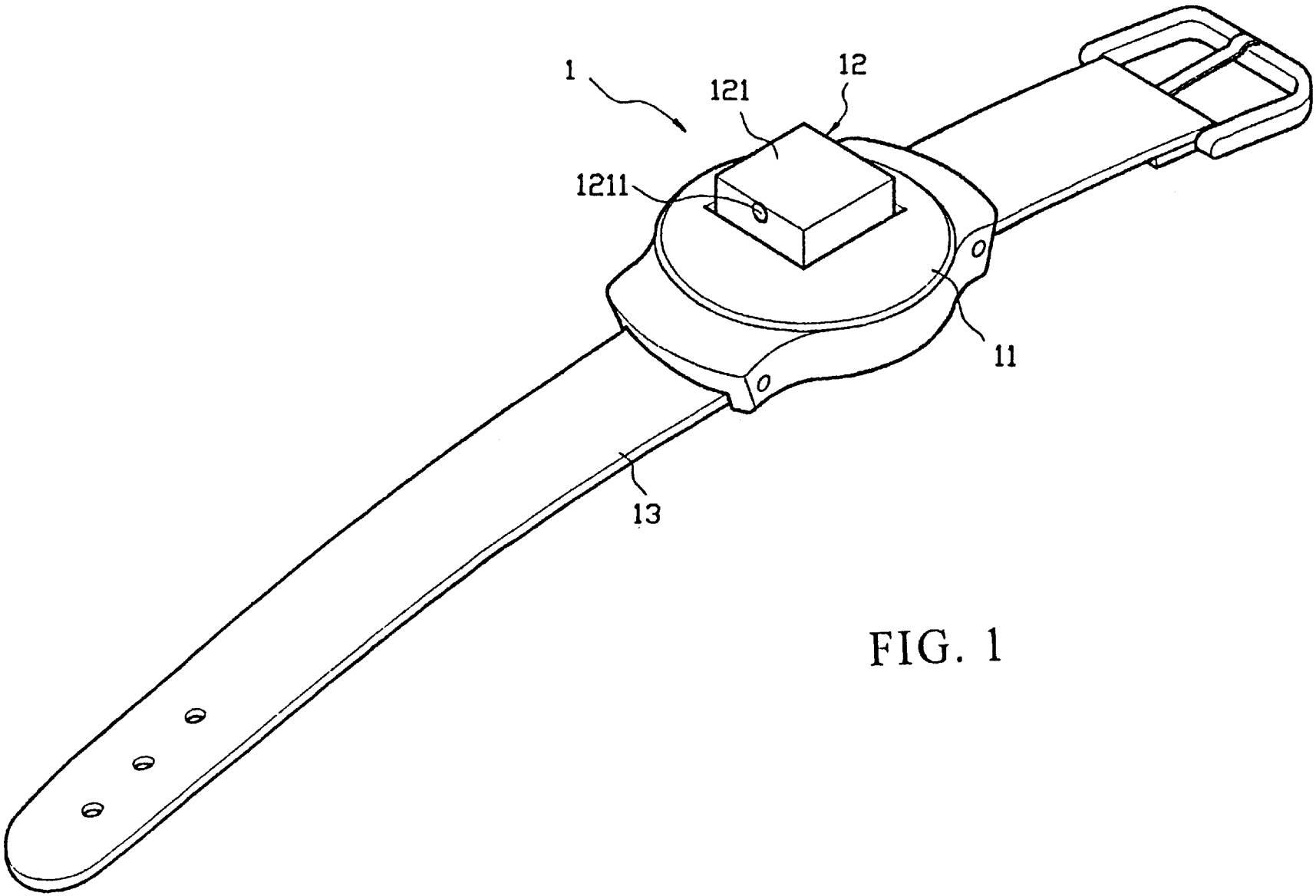
FIG. 1 is a perspective view of a wrist typed instaneous sprayer according to this invention.
Figure 2:
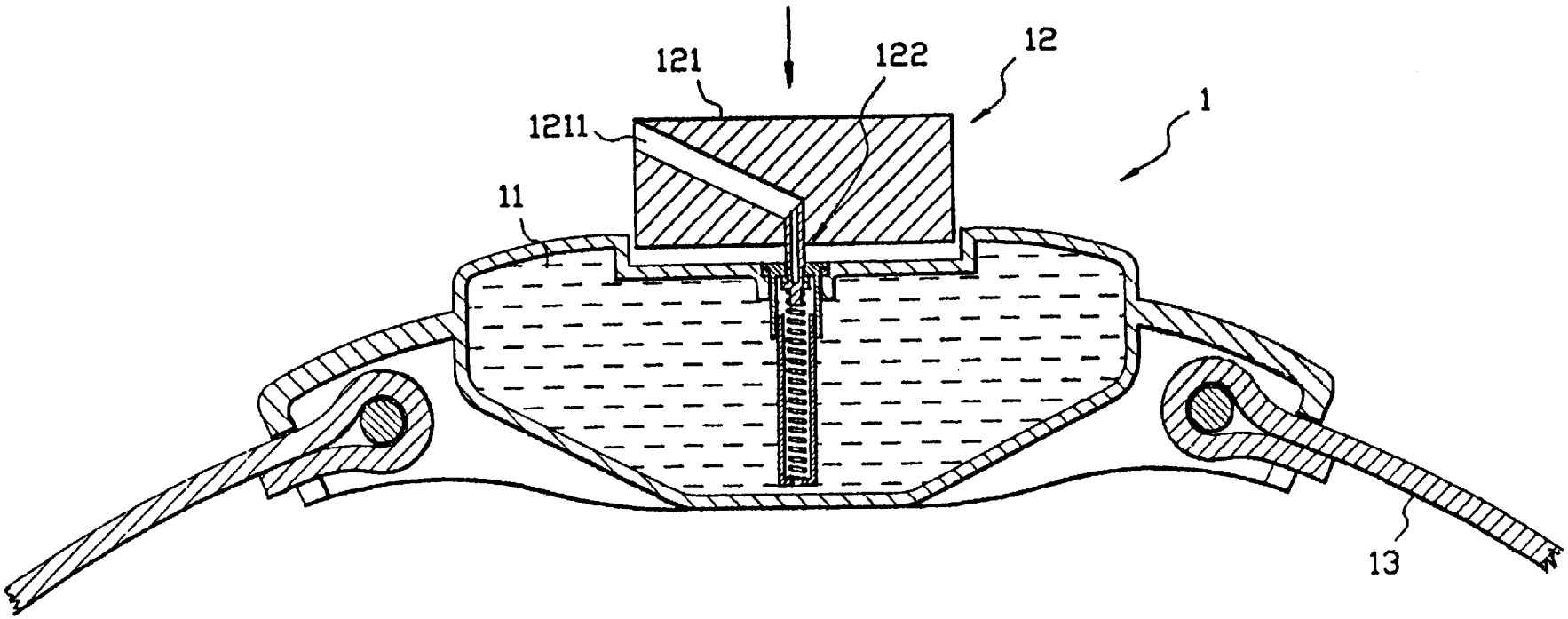
FIG. 2 is a partially longitudinal sectional view of FIG. 1.

Referring to FIGS. 1 and 2, a wrist typed instaneous sprayer 1 comprises a pressurized storage tank 1 having a volume for containing approximately 5 $cm^3$ of the liquefied gas, the tank body being made of a transparent material for detecting the remainder of the liquefied gas, and the pressurized storage tank permitting various liquefied gases, such as tear gas, first aid drug or liquefied oxygen to feed therein; button releasing means including a button 121 to control the releasing of the content in the tank, button 121 being provided therein with a nozzle 1211 for the released liquefied gas to gasify and spray upward; and a wrist strap 13 to be worn on the wrist for adjusting the looseness. In an urgent case, one who wears the wrist typed instaneous sprayer 1 on the wrist may bend his elbow to push the button for readily reacting to proceed a short distance self-defense, or a first aid in case that a patient gets sick abruptly, or a fire escape by spraying the liquefied oxygen into a plastic bag for breathing in case that a fire occurs.

Figure 3:
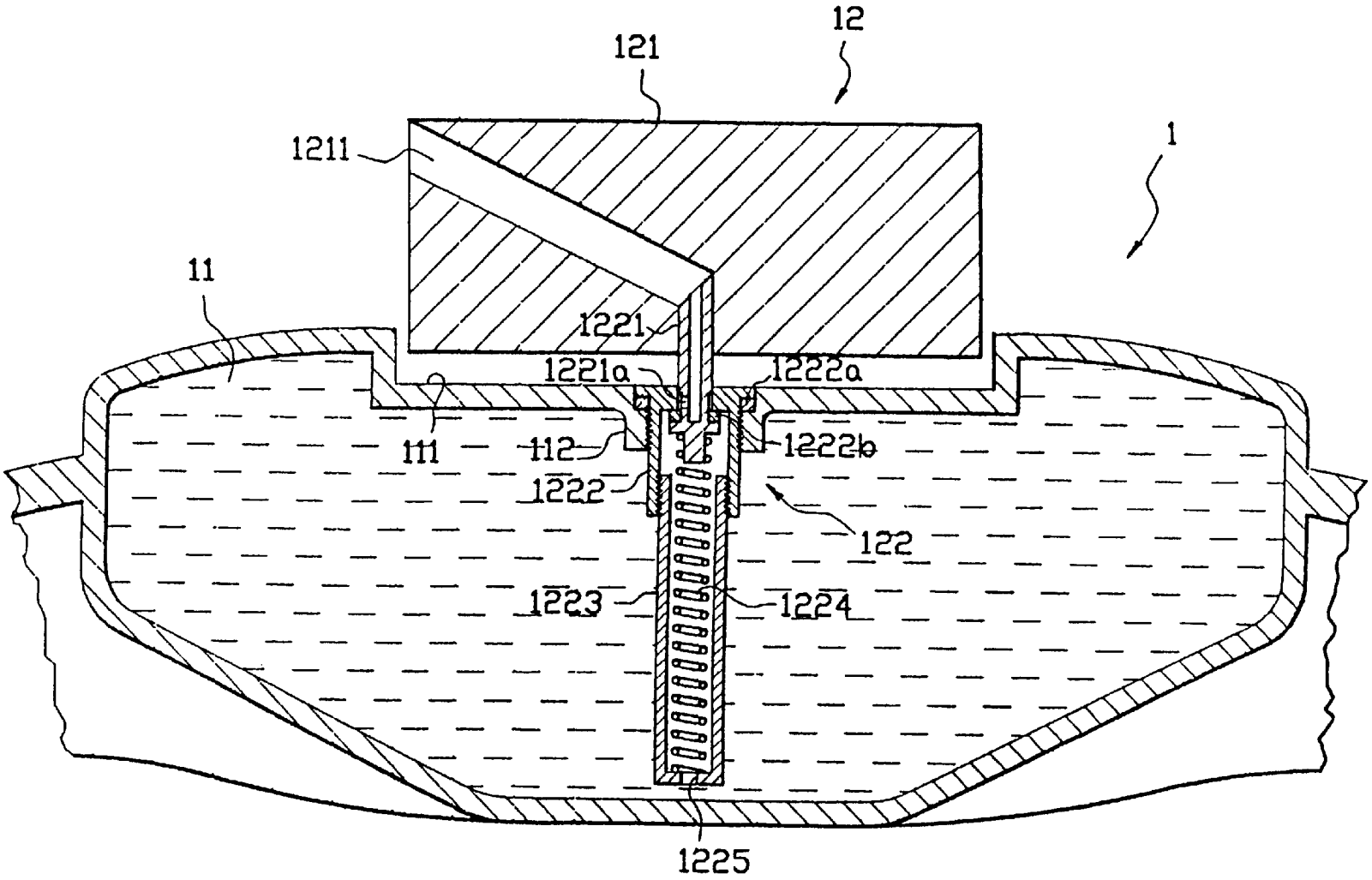
FIG. 3 is a partially enlarged view of FIG. 2, illustrating an unused button releasing means in a closed position.
Figure 4:
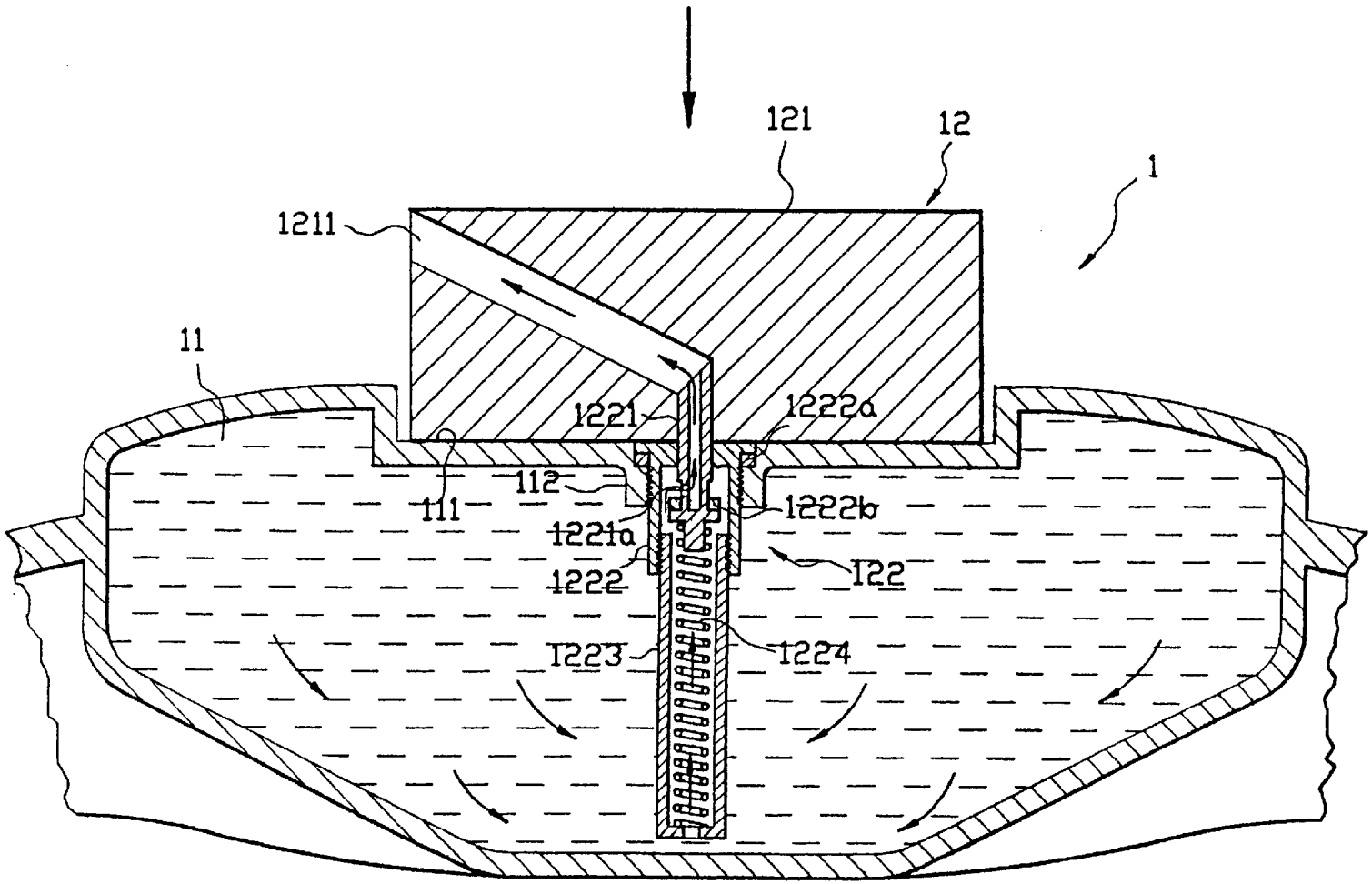
FIG. 4 illustrates a use condition of FIG. 3 wherein the button is pushed for the button releasing means to constitute as a passage.

Further, referring to FIGS. 3 and 4, the pressurized storage tank 11 is a transparent container gradually getting bigger toward the center thereof. A recess 111 is formed on the upper portion beneath the button 121 with a clearance left therebetween for moving upward and downward. Beneath the center of the recess 111 a socket 112 having a through hole is formed. The socket 112 which is internally threaded engages with the base seat 1222 having external thread to constitute a releasing device 122. As shown, a conventionally structured releasing device 122 comprises: a guide pipe 1221 having a center hole but closed on the bottom end, in which the guide pipe 1221 beveled on the top end thereof in correspondence to the oblique sprayer outlet 1211 of the button is inserted into the lower portion of the button 121, while the base portion of the guide pipe is a flange having a greater diameter and a releasing hole 1221*a* pierces through the wall thereof above the flange to communicate with the center hole; a base seat 1222 forming with an inner hole of a greater diameter and a through hole centrally on the upper portion thereof respectively, the through hole allowing the guide pipe 1221 to extend therein and slide up and down, in which a releasing pipe 1223 extending downwardly adjacent to the bottom of the pressurized storage tank 11 threadedly engages with the lower end of the base seat 1222 and a through hole 1225 is provided on the bottom portion of the releasing pipe; a tension spring 1224 received in the releasing pipe 1223 with the lower end abutting against the flange defined by the through hole 1225 on the bottom portion of the releasing pipe 1223, and the upper end abutting against the lower end of the guide pipe 1221; and seal rings 1222*a* and 1222*b* are respectively provided on an interface between the socket 112 at the center of the recess and the base seat 1222 of the releasing means 122 and an interface between the base seat 1222 and the guide pipe 1221 whereby the pressurized storage tank 11 maintains a desired fluid-tightness. Thus, in a condition prior to use, as shown in FIG. 3, the guide pipe 1221 under the force of the tension spring 1224 keeps the releasing hole 1221*a* hidden within the wall of the base seat 1222 in a closed position. In an abrupt situation, as shown in FIG. 4, one presses down the button 121 to urge the guide pipe 1221 against the force of the tension spring 1224, thus exposing the releasing hole 1221*a*. Then the liquefied gas is released along the direction of arrow to the nozzle 1211 to gasify, and subsequently obliquely sprayed out from the nozzle 1211.

Figure 5:
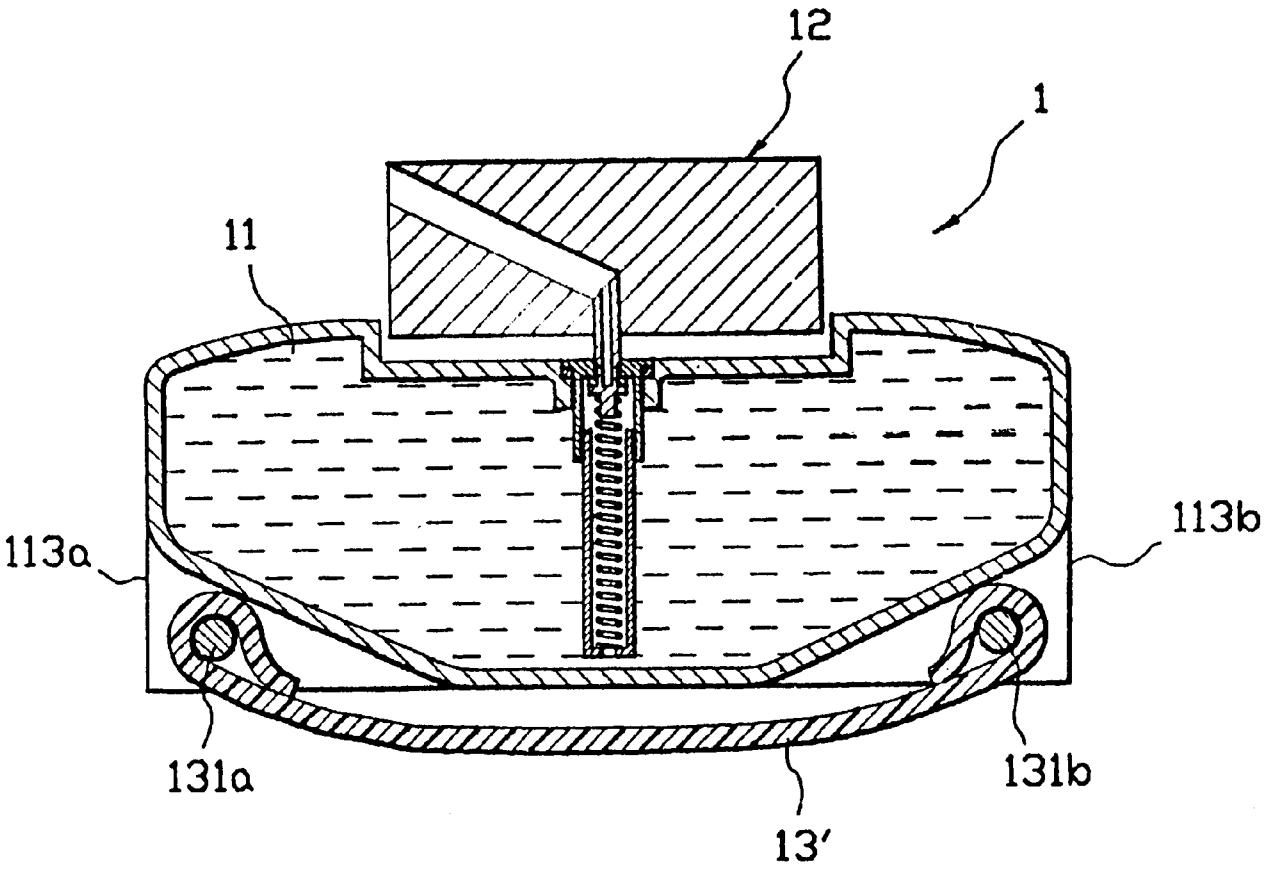
FIG. 5 is a sectional view of a tie member of this invention cooperating with another embodiment of the wrist typed sprayer.
Figure 6:
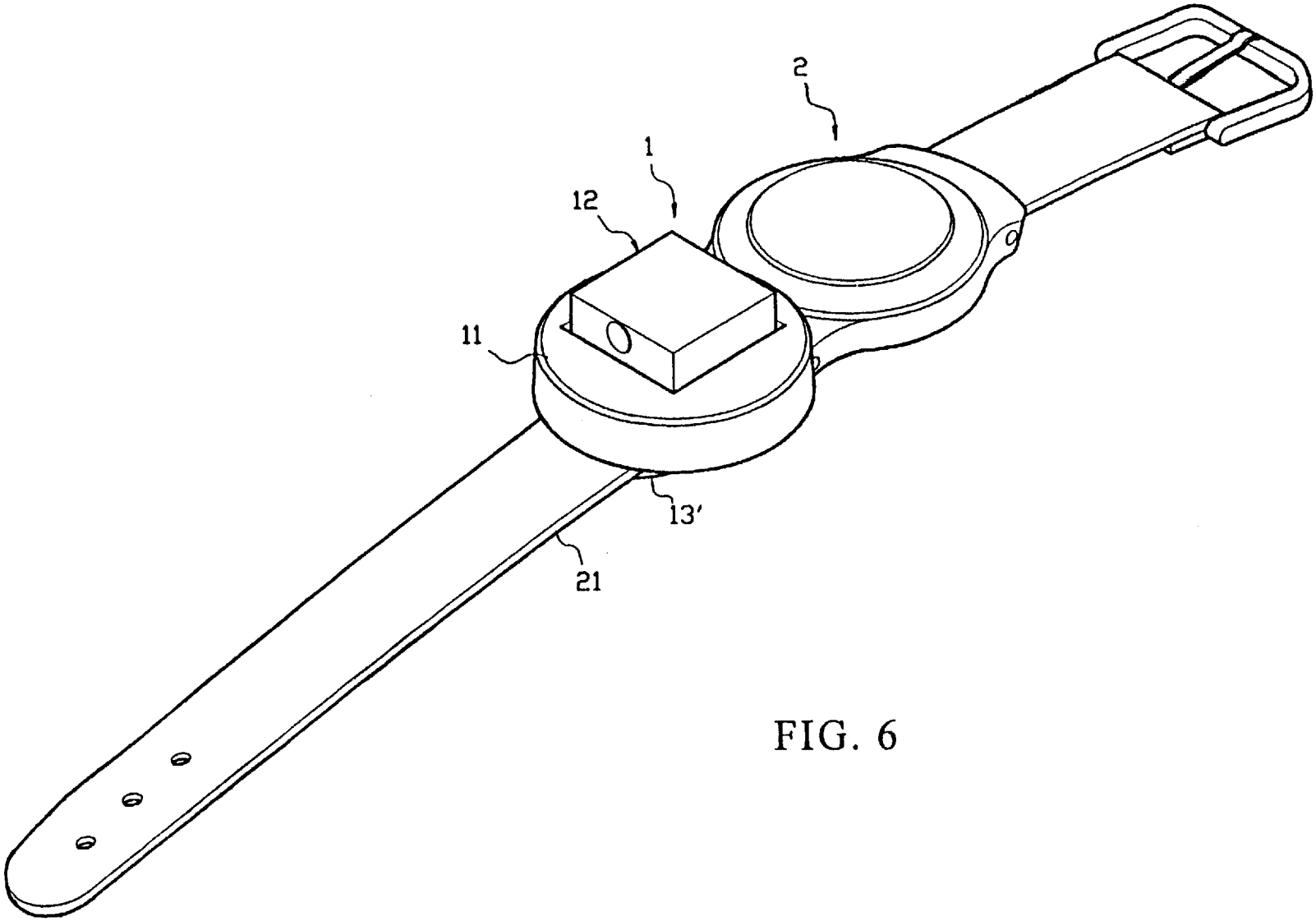
FIG. 6 is a perspective view of the embodiment as shown in FIG. 5, illustrating that it may be worn on the other watch strap with an elastic strap.

FIG. 5 illustrates an embodiment of this invention with an elastic strap 13' attached thereon. This embodiment is the same as the embodiments as noted above except that pins 131*a* and 131*b* are respectively provided on pin seats 113*a* and 113*b* for securing both ends of the elastic strap 13', thus forming an elastic wearing clearance for a watch strap 21 of a watch to pass through and juxtapose with the watch 2 on the wrist as shown in FIG. 6.

Figure 7:
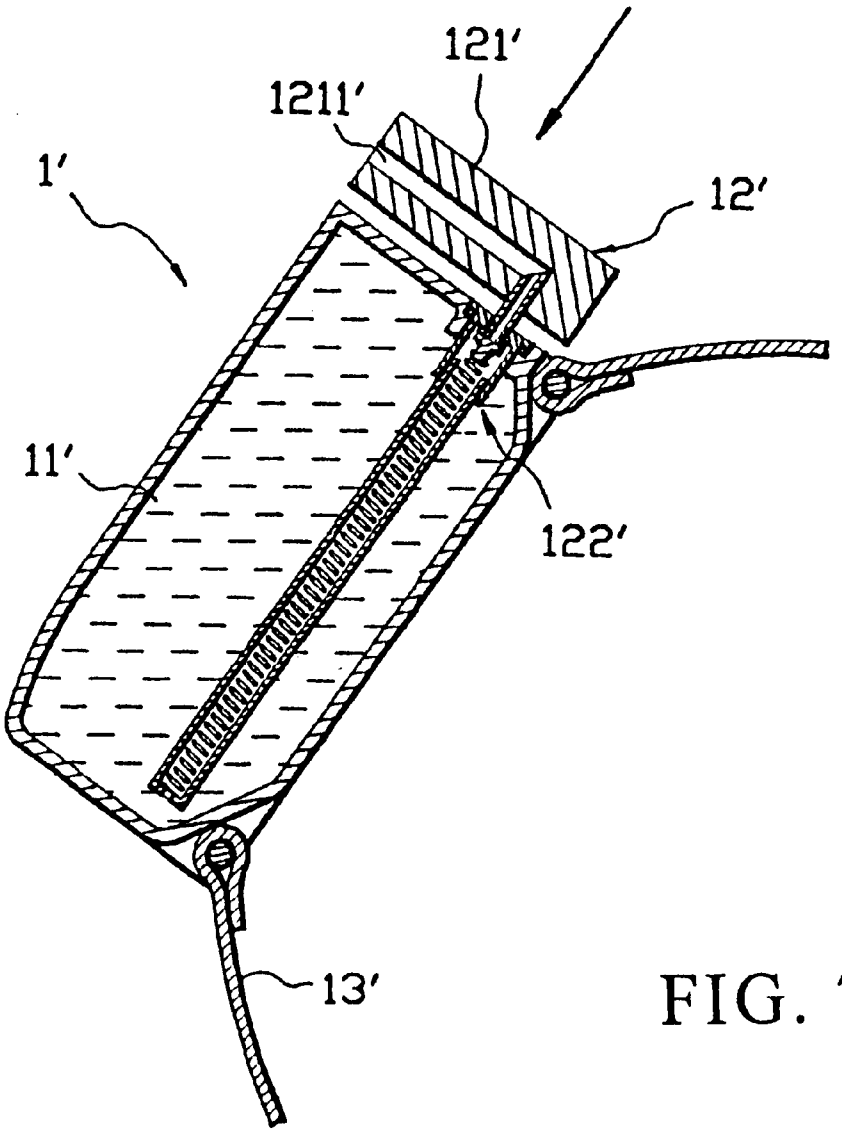
FIG. 7 is a sectional view of the second embodiment according to this invention, illustrating that button releasing means is provided on one side of the pressurized storage tank.

FIG. 7 shows another embodiment of this invention, which is the same as the embodiments as described above except that button releasing means 12' is provided on one side of a pressurized tank 11' with a nozzle 1211' and a button 121' parallel to each other whereby in use the nozzle 1211' faces the object and then the button is pushed down. Numeral 122' designates the releasing device.

A cap body may be further provided in the above described embodiments of this invention to prevent the button from being touched inadvertently.

Figure 8:
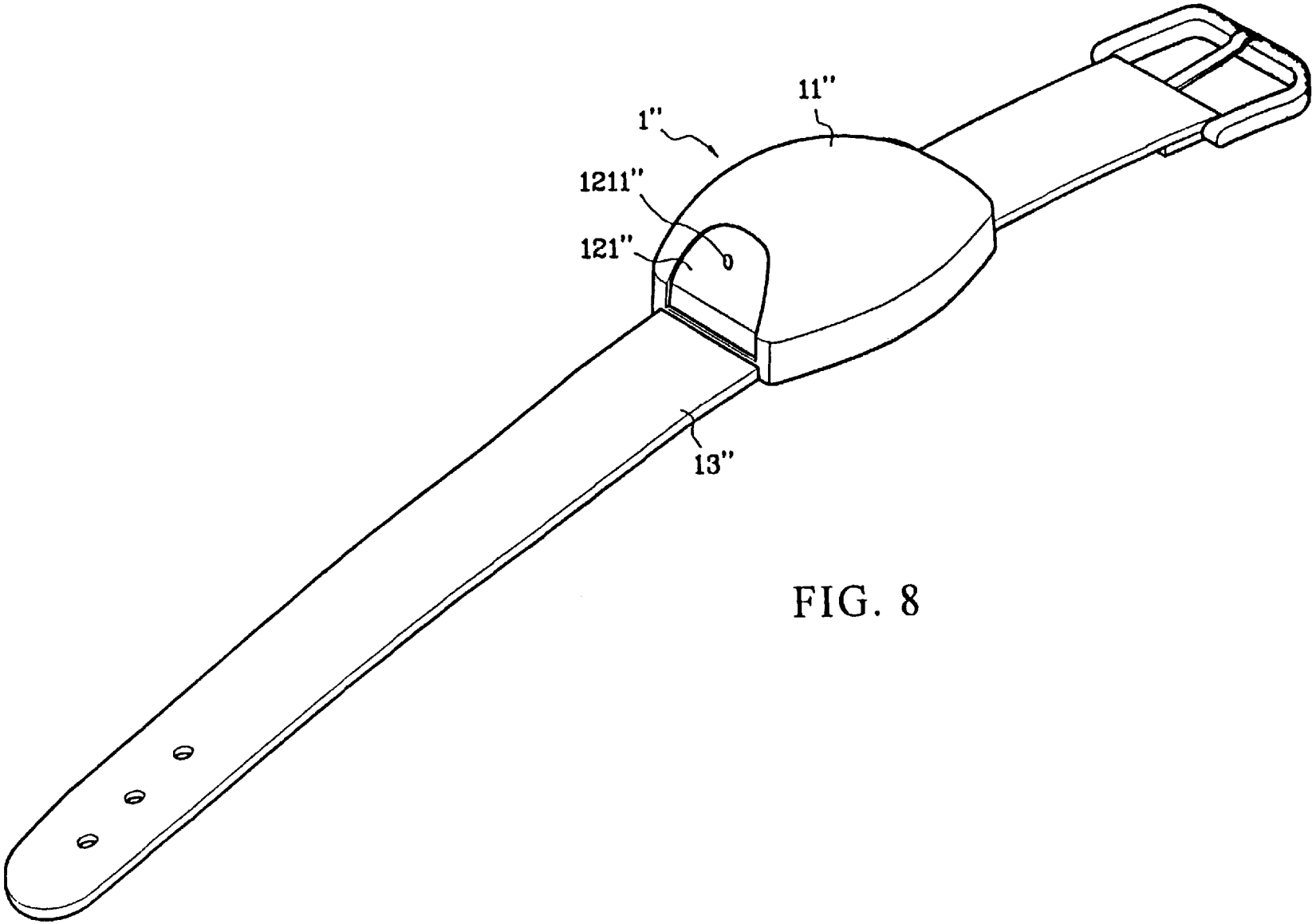
FIG. 8 is an oblique view of the third embodiment according to this invention, illustrating that button releasing means is hidden on one side of the pressurized strap tank.
Figure 10:
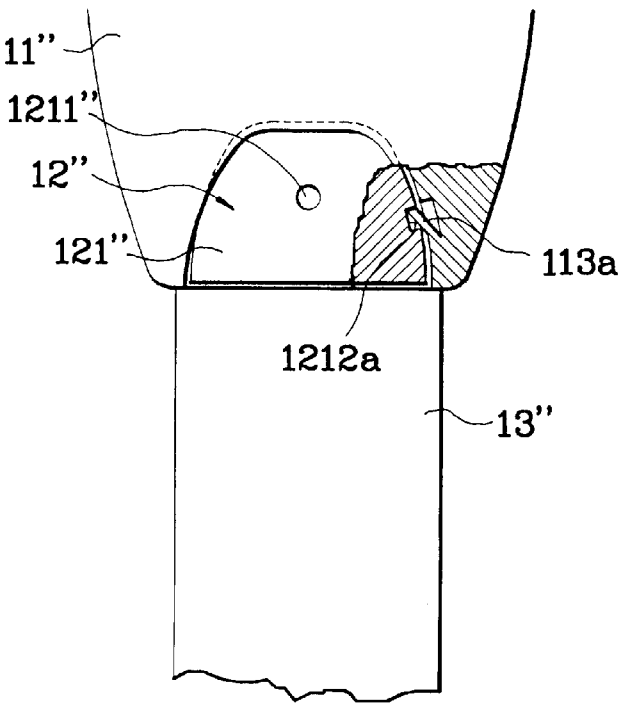
FIG. 10 is a partially plan view of FIG. 8 wherein some parts are sectional.
Figure 9:
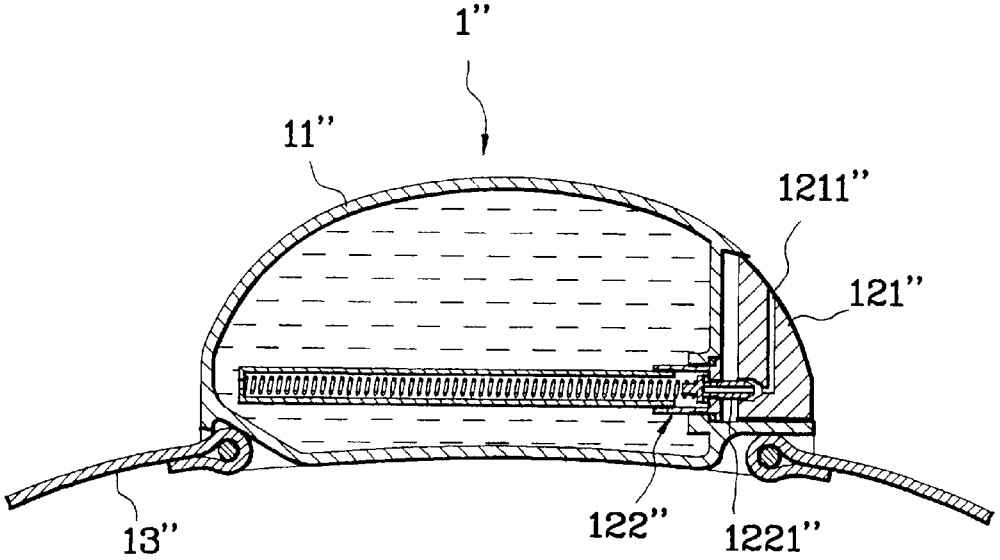
FIG. 9 is a partially longitudinal view of FIG. 8.

FIG. 8 illustrates still another embodiment of this invention, in which button releasing means 12", while a button 121" is hermetic by being received in an enclosure defined by the wall of the pressurized storage tank 11" and the bottom portion thereof. Further, referring to FIGS. 9 and 10, the button 121" and the guide pipe 1221" loosely engage with each other whereby the button 121", is initially pressed to define an idle and bumping period, while the button 121" is further pressed to force the guide pipe 1221" into a communicating position. On both sides of the button 121", there are respectively provided with recesses 1212*a* and 1212*b* (not shown). Projecting tangs (not shown) are provided on a position where the pressurized storage tank 11" and the recesses 1212*a* and 1212*b* are opposed and adjacent to each other for the button to secure thereon and slide in a single one direction. Except such arrangement, the other parts are the same as those of the embodiments as described above.

While the foregoing description and drawings represent the preferred embodiments of the present invention, it will be apparent to those skilled in the art that various changes and modifications may be made therein without departing from the true spirit and scope of the present invention.

What is claimed is:

1. A sprayer to be worn on the wrist of a user comprising:

a pressurized storage tank having pins on both sides and filled with a gas under high pressure or a liquefied gas, said storage tank having a top portion, button releasing means screwed onto said top portion of said pressurized tank;

a button connected with said button releasing means, said button having a nozzle formed on said button, said nozzle communicating with said releasing means, said releasing means being in a communication position upon pressing down said button;

a wrist strap fastened onto the pins on both sides of said pressurized tank for wearing on the wrist of the user, wherein said nozzle of said button faces upwardly.

2. The sprayer according to claim 1 wherein said gas is a tear gas, said sprayer serving as a short distance self-defense device.

3. The sprayer according to claim 1 wherein said gas tank is a first aid drug, said drug being a trachea expander to serve as a first aid device for a respiratory patient.

4. The sprayer according to claim 1 wherein said pressurized storage tank is filled with liquefied oxygen.

5. The sprayer according to claim 1 wherein said wrist strap is adjustable by the user.

6. The sprayer according to claim 1 which comprises an elastic strap, said elastic strap is fastened onto said pins on said both sides of said pressurized storage tank to define a wearing clearance for said elastic strap to attach to said wrist strap.

7. The sprayer according to claim 1 wherein said storage tank has two ends and both ends of said pressurized storage tank are oblique.

8. The wrist sprayer according to claim 1 wherein said button is provided on one side of said pressurized storage tank.

9. The sprayer according to claim 8 wherein both sides of said pressurized storage tank are oblique and two pins are provided beneath said oblique sides.

10. The sprayer according to claim 1 wherein said storage tank has a bottom, said button is hermetic and is provided on one side of said pressurized storage tank and said button is received in an enclosure formed by the wall of said pressurized storage tank and the bottom portion thereof.

11. A sprayer according to claim 10 which comprises a releasing device, said releasing device comprising a guide pipe, said guide pipe having a center hole and being closed at the bottom, said button and said guide pipe loosely engage with each other whereby said button is pressed initially to define an idle and bumping period.

12. A sprayer according to claim 1 wherein said pressurized storage tank is made of transparent material.

* * * * *